US007866768B2

(12) United States Patent
Mallouk

(10) Patent No.: US 7,866,768 B2
(45) Date of Patent: Jan. 11, 2011

(54) MODULAR STORAGE ASSEMBLY

(76) Inventor: Yves Mallouk, 30 rue Racine, Bry sur Marne (FR) F-94360

( * ) Notice: Subject to any disclaimer, the term of this patent is extended or adjusted under 35 U.S.C. 154(b) by 732 days.

(21) Appl. No.: 11/572,271

(22) PCT Filed: Jul. 22, 2005

(86) PCT No.: PCT/FR2005/001902

§ 371 (c)(1),
(2), (4) Date: Jan. 18, 2007

(87) PCT Pub. No.: WO2006/018520

PCT Pub. Date: Feb. 23, 2006

(65) Prior Publication Data

US 2008/0042534 A1 Feb. 21, 2008

(30) Foreign Application Priority Data

Jul. 22, 2004 (FR) ..... 04 08105

(51) Int. Cl.
*A47B 87/00* (2006.01)

(52) U.S. Cl. ..... 312/107.5; 312/111; 312/219

(58) Field of Classification Search ..... 312/107.5, 312/107, 108, 111, 198, 217, 218, 219, 216; 220/23.86, 23.83, 380, 324, 315; 292/32, 292/33, 37, 38, 42, 171, 141, DIG. 18, 9, 292/34; 70/78–86, 264, DIG. 56, DIG. 66; 109/56, 57, 53

See application file for complete search history.

(56) References Cited

U.S. PATENT DOCUMENTS 368,697 A * 8/1887 Wollensak ..... 312/216
1,945,381 A * 1/1934 Russell ..... 312/127
2,333,511 A * 11/1943 Bates et al. ..... 109/53
2,652,308 A * 9/1953 Peterson ..... 312/311
3,421,801 A * 1/1969 Carpenter et al. ..... 312/111
3,602,564 A * 8/1971 Lewin ..... 312/220
3,974,898 A * 8/1976 Tullis et al. ..... 190/3
4,528,916 A * 7/1985 Knight ..... 109/56
4,648,550 A * 3/1987 Cleary, Jr. ..... 232/25
4,660,725 A * 4/1987 Fishman et al. ..... 206/509
4,856,855 A 8/1989 Hasuike
4,893,884 A * 1/1990 Tsuchida et al. ..... 312/107
4,908,728 A * 3/1990 Pinkett ..... 360/137
5,154,291 A * 10/1992 Sur ..... 206/308.1

(Continued)

FOREIGN PATENT DOCUMENTS

DE 843694 C 7/1952

(Continued)

*Primary Examiner*—Darnell M Jayne
*Assistant Examiner*—Andres Gallego
(74) *Attorney, Agent, or Firm*—Gerry J. Elman; Elman Technology Law, P.C.

(57) ABSTRACT

A storage assembly of a type including at least two modules which can be solidly connected to one another. Each of said modules is equipped with structure for accessing at least one storage space, a closure mechanism and a mechanism for solidly connecting the modules to one another. The at least one module includes structure for locking the mechanism for solidly connecting the modules to one another and the closure mechanism for closing off access to at least one module.

5 Claims, 6 Drawing Sheets

U.S. PATENT DOCUMENTS 5,603,558 A * 2/1997 Zimmer ..... 312/290
5,683,030 A * 11/1997 Moore et al. ..... 232/43.1
5,845,524 A * 12/1998 Koehler ..... 70/278.7

FOREIGN PATENT DOCUMENTS

EP 0664980 A 8/1995
EP 0786218 A 7/1997
FR 1381424 A 12/1964
FR 2807926 A 10/2001
GB 1135134 A 11/1968
GB 2129482 A * 5/1984

* cited by examiner

MODULAR STORAGE ASSEMBLY

This invention covers a modular assembly intended for the arrangement and storage of items of different dimensions, in particular tools, where their number and dimensions are likely to change in the course of time.

Whatever the application, be it for leisure or for use by tradespersons or handymen, numerous types of storage boxes or casings are available which allow the satisfactory arrangement and storage of objects with greatly varying dimensions.

Some of these casings are provided with the means to allow their user to combine them in such a way as to suit a specific task and thus to transport only the modules containing the items which are strictly necessary for this task, given that the user will have the possibility to assemble the modules in a more appropriate manner for a different task.

In these types of storage systems, the components are typically provided with various types of storage compartments whose actual layouts and storage space are defined "at manufacture" such that they are not capable of adaptation over the course of time to meet the changing needs of the user. When, for example, these modular components are used in the mechanical field, the use of containers and/or drawers of various capacities allow a user to arrange any small items quite well, such as nuts and bolts, hand and electrical tools. If, for a specific task, the user needs to store a tool in his modular storage system and the dimensions of this tool do not fit the largest container in the user's system, he is obliged to use a supplementary storage system.

But when, for example, on a work site, the user wishes to ensure the security of the materials in the storage containers, he will not only have to successively lock each of the modules comprising the assembly but also have to solidly connect these modules together.

The aim of this invention is to rectify these drawbacks by proposing a modular storage arrangement in which the user will be able not only to solidly connect the various modules together but also be able to lock each of the means of access to each module by using the appropriate locking command provided for in each module.

It is therefore a purpose of this invention to provide a storage arrangement comprising at least two modules which can be solidly connected to each other, each of these modules including a means of access to at one least storage compartment which includes a means of closure, together with the means to solidly connect the modules to each other, and characterized in that each module includes locking mechanisms for both the mechanism for solidly connecting the modules together and for the closure of the access to them.

The locking system, both for the mechanisms which solidly connect the modules together and the system for closure of the access to the modules, can be accessed from a single, centralized command which will be able to be initiated by any one of the module locking commands.

This centralized command for the locking system is located on the front face of each module and, in particular, on the upper section of it.

Each module will include at least one locking bolt mounted for vertical movement and activated by the centralized locking command such that it may take up one of two positions. One is the locking position in which, on the one hand, blocking the means of access to the interior of at least one part of the module is ensured and, on the other hand, locking the means of solidly connecting the modules together is also ensured. The other position is the unlocked position in which these components will be accessible. These locking bolts will be provided with a coupling mechanism which can be activated by the mechanism for solidly connecting the modules together.

It is an advantage that the modules will be able to include a means for centering. The purpose is to ensure the correct positioning of each module relative to the others. For example, these means of centering will comprise a rebate made in the upper and lower sections on their lateral sides, this rebate being such that one is "recessed" and the other is "protruding".

The various ways of configuring this invention are not limited to the examples given below which will now be described with reference to the attached drawings in which:

FIG. 1 is a front view of an assembly of several modules intended to form an assembly as per the invention.

FIG. 1*a* is a detailed view of a part of FIG. 1.

Figure 7:
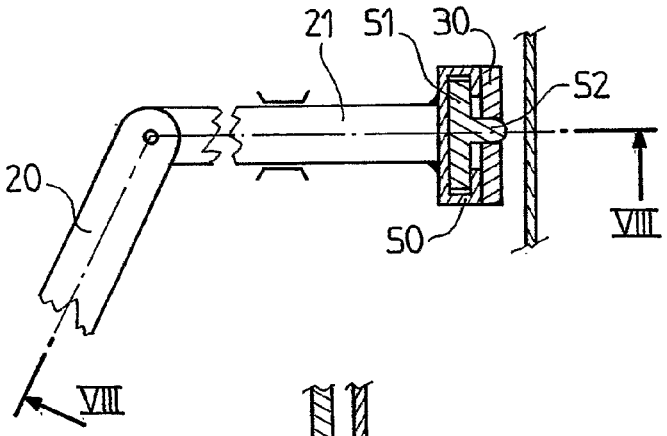
FIG. 7 is a partial view, in section, following section line VII-VII in FIG. 8*a* of the system which ensures the locking of the mechanisms for solidly connecting modules together.
Figure 8B:
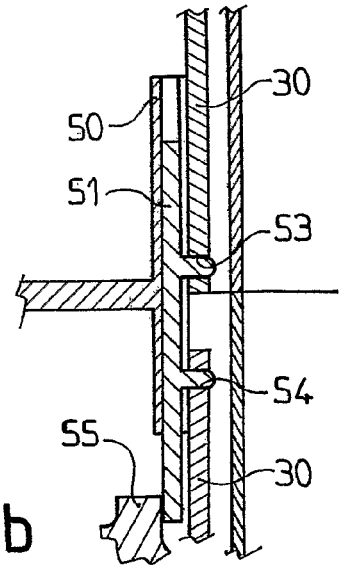
Figure 8A:
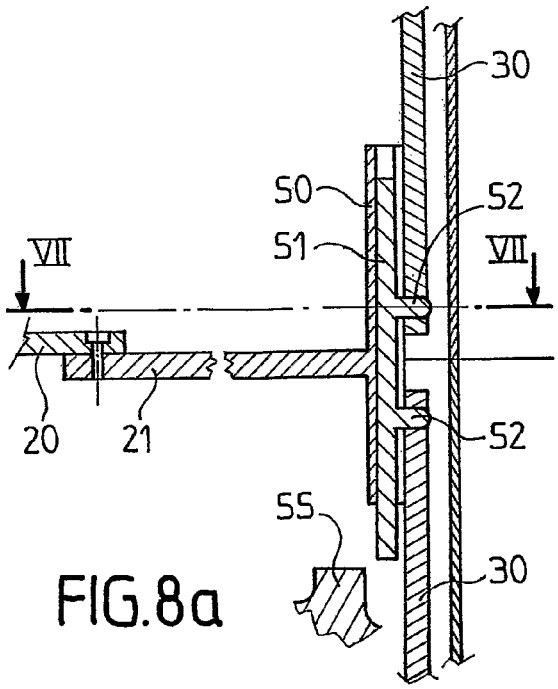

FIGS. 8*a* and 8*b* are partially enlarged sectional views which follow section line VIII-VIII in FIG. 7. These views show the systems which ensure both the locking for the mechanisms for solidly connecting the modules together as well as for the coupling of the locking bolts for two adjacent modules.

Figure 9:
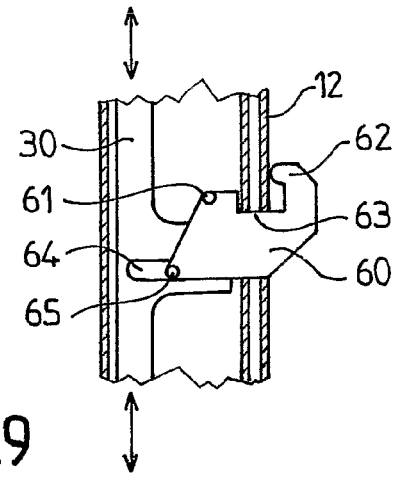

FIG. 9 is a partial view showing a variant in the implementation of a locking system for the drawers in a module.

Figure 10:
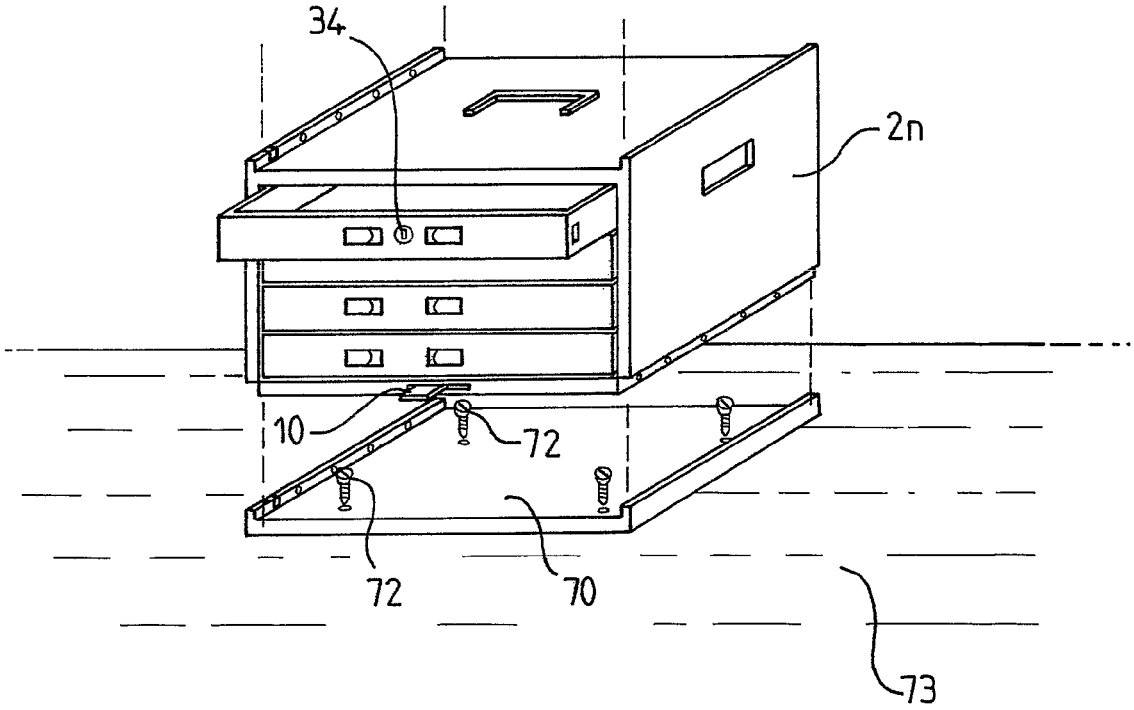

FIG. 10 is a partial and perspective view showing modular assembly and means of fixing 70, 72, to the mounting surface 73

Figure 1:
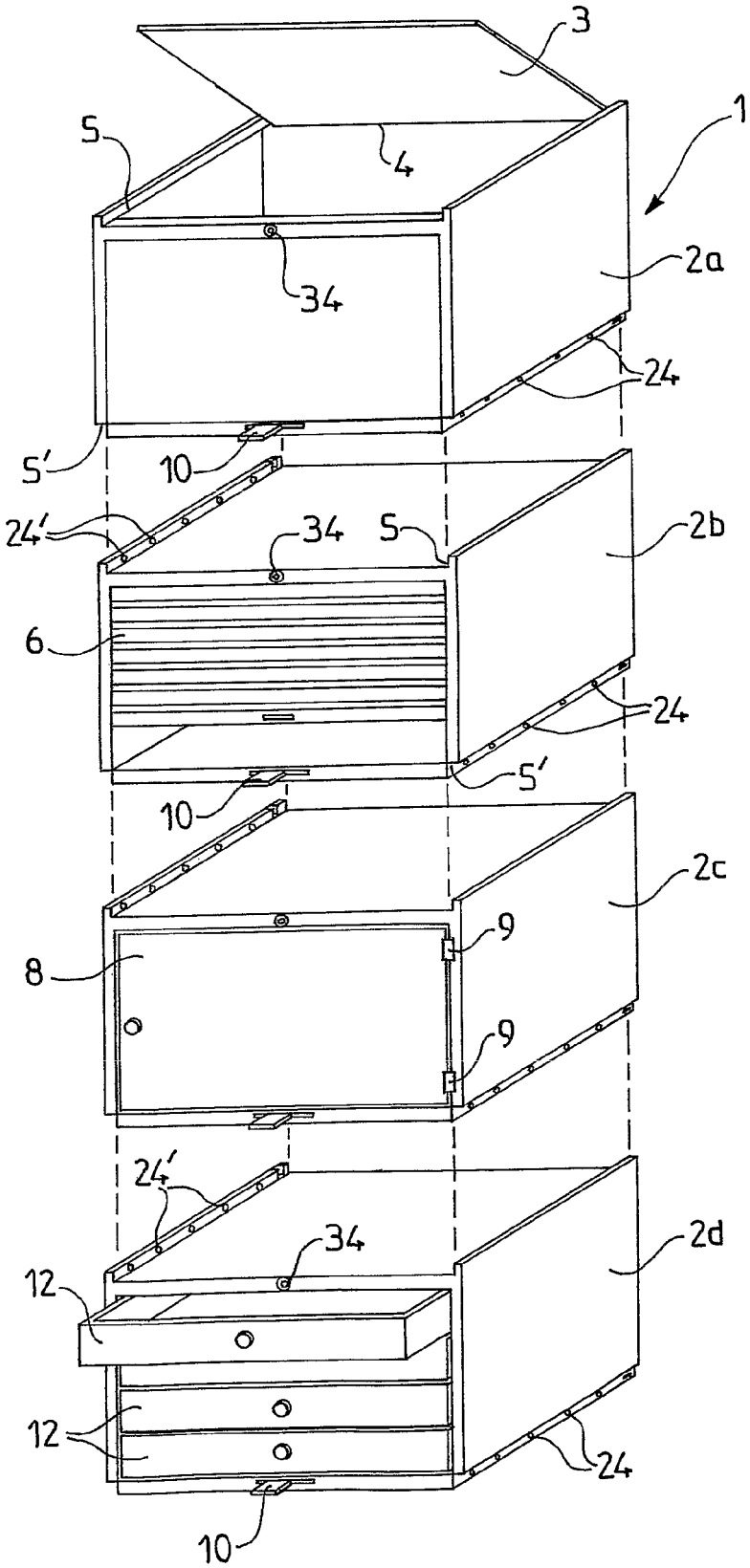

Using the invention, FIG. 1 shows one variant of a modular assembly arrangement comprising four modules 2*a*, 2*b*, 2*c* and 2*d* intended to be combined by placing one on top of the other. Each of these modules is provided with a means of closure, allowing access to its interior storage space to be controlled. As an example, in FIG. 1, each module has been selected as being different from the others. Hence, the topmost module 2*a* includes a horizontal top cover 3 which is installed for pivoting around hinge 4.

Access to module 2*b* interior storage space is achieved using a front curtain 6 comprising a horizontal series of flat plates of the type commonly used, for example, in roller shutters. Access to module 2*c* interior storage space is via a front door 8 which is mounted and pivots around two hinges 9. Finally, the bottom module 2*d* comprises a set of four, equal size, horizontal drawers 12 which divide the interior storage space of the module into four secondary interior storage compartments.

Figure 1A:
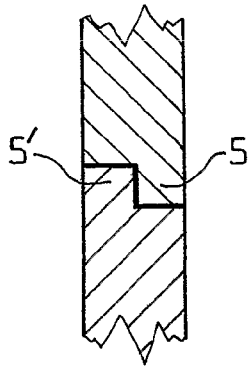

To ensure that each of these modules is correctly positioned with respect to the adjacent module below it and on which it is installed, the upper and lower sections of the lateral sides of the modules each have a machined groove 5-5'. These grooves are complementary in design and shown schematically in FIGS. 1 and 1*a*.

Figure 2:
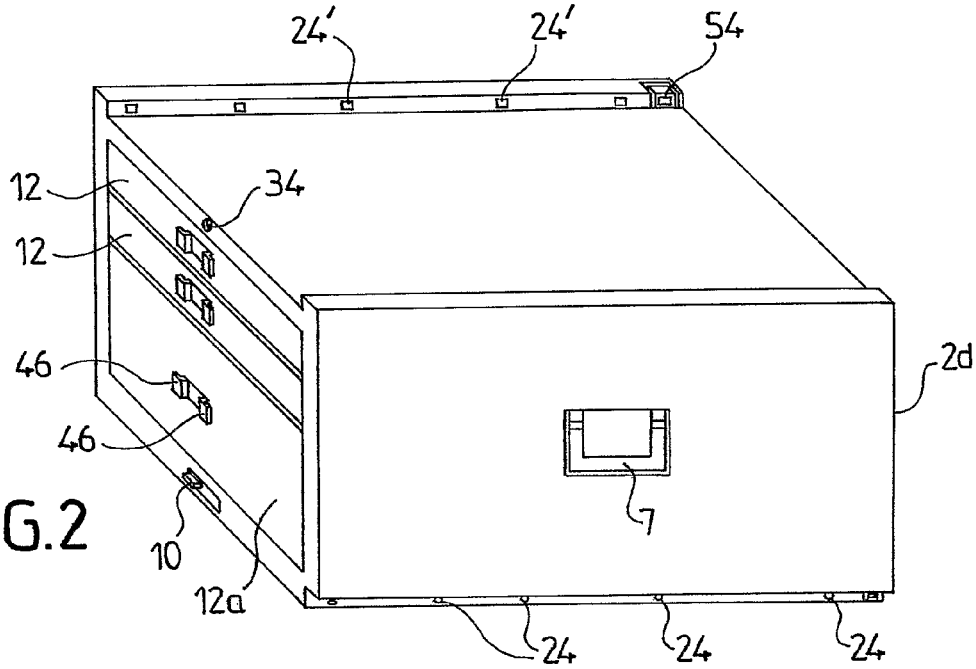
FIG. 2 is a view, in perspective, of an example of a module to be assembled.

FIG. 2 shows a variant of module 2*d* in more detail. This module comprises 3 drawers, one above the other. The lowest drawer 12*a* has the greatest height. Gripping handles 7 can be provided on the two opposite sides of the module.

When the modules are stacked, they are solidly connected together in such a way that they form a single block only. Using this invention, the means for solidly connecting them together can be very diverse. By way of examples, several specific systems are described below with reference to the schematic diagrams.

Figure 3:
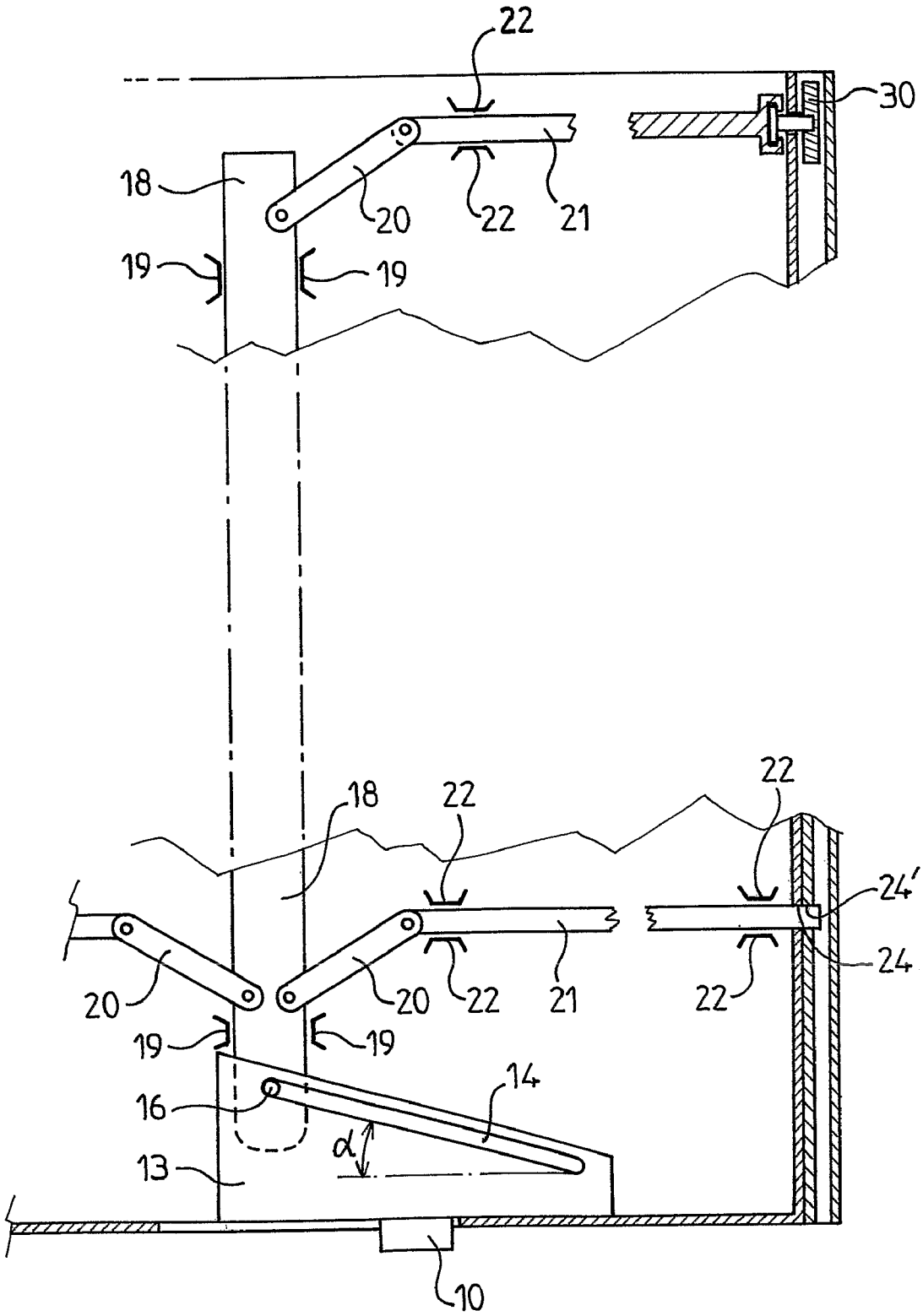
FIG. 3 is a partially sectioned schematic view from above of an example of the mechanisms for solidly connecting modules together.

To solidly connect the modules together, control command knob 10 is used. As shown in FIGS. 2 and 3, this is located at the base of each of the modules. It comprises a small plate 13, roller mounted in the transverse direction, using mechanisms not shown in the diagram. This small plate 13 is parallel to the base of the module and includes slot 14 inclined at an angle $\alpha$ to the front, inside wall and is displaced using command knob 10. Slot 14 is joined to lug 16 located at the end of lever 18 which is roller mounted on roller guide mechanism 19. A series of six connecting links 20 are located along the length of lever 18 (of which only the first and last of the six links are shown in the diagram). These are articulated on the lever and extended by shafts 21 which are roller-mounted between guides 22 and which act as locks. For this purpose, the ends of the first five series of shafts 21 are designed to engage with holes 24 provided in module 1. The upper section of each module also includes holes 24' which are located opposite holes 24 of the lower module.

In these situations, with the four modules in place, and if it is required to ensure they are solidly connected together, knob 10 is displaced from left to right. The resultant effect of this is that shafts 21, associated with connecting links 20, are displaced from the left towards the right, in such a way that their end traverses hole 24 then hole 24' on the lower, adjacent module. This ensures that these modules are solidly connected together. This procedure is repeated for each other module to ensure that all modules in the assembly are solidly connected together. Naturally, to free the modules from each other, the inverse operation is carried out.

Figure 4:
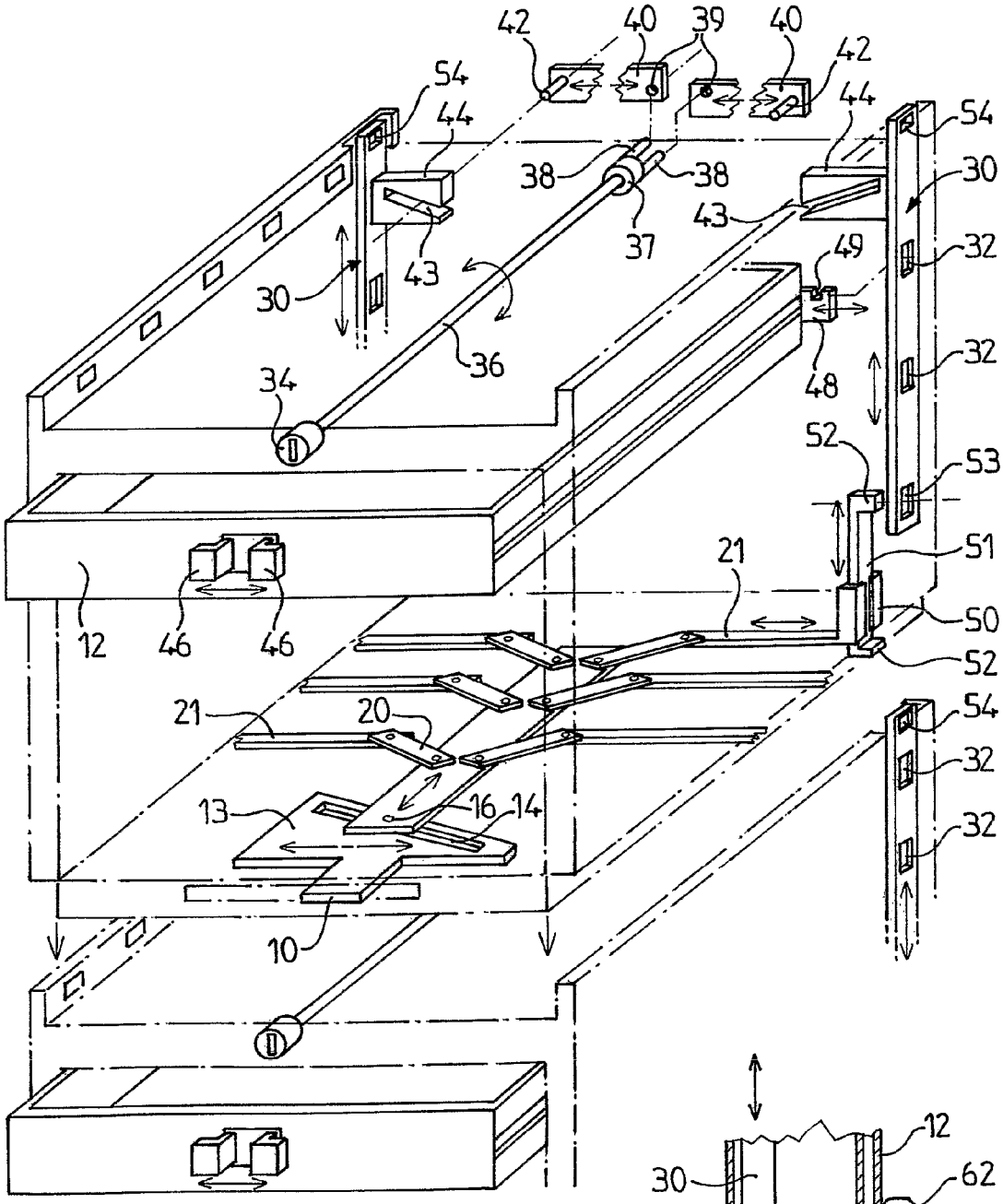
FIG. 4 is a partially exploded view of an example of the mechanisms for solidly connecting and locking modules together as per the invention.

Referring to drawers 12 and 12*a* in this arrangement, the methods of access to the interior of the modules include the mechanisms to ensure that they are solidly connected together and that they are locked on the module. As a consequence, and as shown in the diagrams, each side of the rear section of each module is provided with a vertical sliding locking bolt 30 which moves on guides not shown in the diagram. This locking bolt comprises a flat shaft with rectangular, slotted holes 32 evenly separated along its length. Various means can be used to vertically displace locking bolts 30. One such method is shown in FIG. 4 and comprises a locking control 34 which is built into the upper section of the module face and extends towards the rear of the module using cylindrical shaft 36 terminating on boss 37. This boss is provided with two longitudinal fingers 38 which engage with holes 39 made in two transverse plates 40 which are provided with guides. The guides are not shown in the diagram but allow horizontal displacement of their external extremities when shaft 36 is turned using locking control 34. Each of these displacements is limited by lug 42 which engages with an inclined slot 43 on mounting plate 44, in turn solidly connected to each of locking bolts 30 such that the rotational movement of command shaft 36 ensures the upward or downward displacement of the locking bolts, dependant on the direction of rotation of locking control 34.

Figure 6:
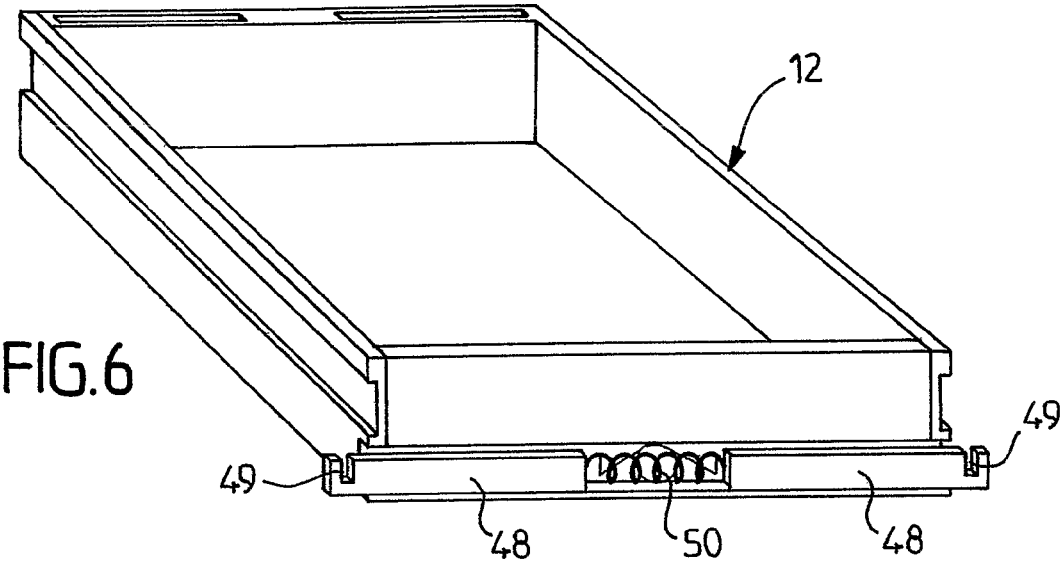
FIG. 6 is a view, in perspective, of a drawer viewed from the rear.

The front sections of drawers 12 are provided with a control device. By way of example, this comprises two push buttons 46 which slide transversely. Each of these, using a strap not shown in the diagram, are tied down to a corresponding sprung bolt 48 located in the rear section of drawer 12 (FIG. 6). A compression spring 50 is located between the two sprung bolts 48 and sets the latter in the open position. Thus any movement by which the two push buttons 46 come together has the effect of bringing one or the other of the two sprung bolts 48 up against the force of spring 50. Moreover, the upper section of each sprung bolt 48 has a vertical slot 49 which is open towards the top.

In normal operation, sprung bolts 48 engage in slots 32 of locking bolt 30 such that, to open drawer 12, the user has to retract the bolts by bringing the two push buttons on control knob 46 together. When the latter are released, the bolts revert to their open position. This ensures that the drawers are held in position if they are in the closed position.

It should be noted that the elongated slots 32 made in locking bolts 30 allow them to be displaced towards the base while ensuring that the drawers are held in position without having to lock them. This remains the situation until the upper section of slots 32 engage notches 49 in sprung bolts 48 when locking bolt 30 is displaced towards the base. Bolts 48 are then locked and the user is not able to open the drawers 12 by operating the push buttons on knob 46. This is because the bolts can no longer slide to be retracted as they are prevented from doing so by locking bolt 30.

The device covered by this invention also ensures that locking all the means of access to the respective interior storage spaces in the various modules is possible. This is because any one of the locking mechanisms included in this particular installation uses any one of locks 34.

For this reason it includes the means to ensure coupling between the various relevant locking bolts. By way of example, one such method of establishing these capabilities has been shown here.

Figure 5:
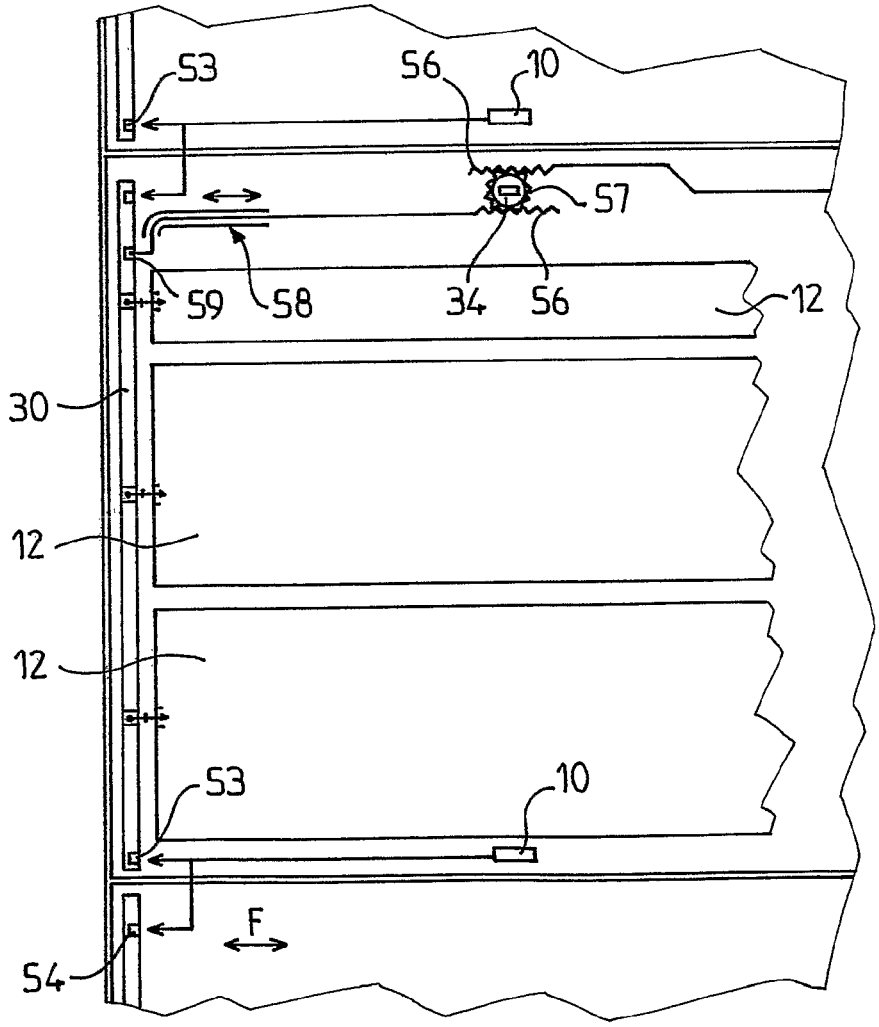
FIG. 5 is a partial schematic view showing an example of the centralized locking system for drawers for several modules.

As shown schematically in FIG. 5, and in more detail in FIGS. 7 and 8, use is made of the last two series of connecting links 20 and shafts 21. The free extremity of each of these shafts is here terminated on a vertical section which is perpendicular to it and which forms a slide runner 50 on the interior of which is mounted sliding block 51 and provided with two perpendicular lugs 52. It should be appreciated that, in these conditions, when the user ensures that the modules are solidly connected together by displacing knob 10 from left to right, this has the effect of displacing the extremities of shafts 21 to form a lock in corresponding receptor holes 32 of locking bolt 30. Additionally, it also displaces the two lugs 52 with respect to lower hole 53 in the module locking bolt. This, in turn, ensures that the command is correctly executed and the lug is in the upper hole 54 of locking bolt 30 of the lower, adjacent module. Locking bolts 30 of this module and the lower module are thus coupled together. By proceeding in this manner from one module to the next, all locking bolts 30 from the various modules are coupled.

Once locking bolt coupling is completed, it is then possible to lock the drawer assembly using any one of locks 34.

The invention also ensures the locking of the mechanism for solidly connecting the modules together. In this way, as shown in FIGS. 8*a* and 8*b*, a stop 55 is located behind sliding block 51 so that, once locking bolt 30 has been lowered to ensure drawer locking, it is no longer possible to separate the modules by displacing knob 10 towards the left as stop 55 prevents sliding block 51 from moving backwards.

Of course, using the invention, the displacement of the locking bolts could be done using methods other than those described above. As shown schematically in FIG. 5, racks 56, together with a pinion 57 solidly joined to control device 34, could also be used. These racks are respectively extended in the direction of locking bolts 30 using a spiral spring covered by sleeve 58 and terminated by push button 59. This ensures locking bolt 30 displacement as a function of the direction of rotation of control device 34.

Similarly, as shown in FIG. 9, the locking of drawers 12 will be able to be ensured by lock 60 which comprises a plate which is installed to pivot around pin 61. This pin is provided with finger 62. In the locked position this finger can penetrate slot 63 of drawer 12. The pivoting movement is applied to lock 60 by the vertical displacement of locking bolt 30. For this purpose, the last mentioned is provided with a transverse slot 64 as receptor for lug 65 of lock 60. It should be noted that, when the locking bolt is displaced vertically, the lock is forced to rotate in one direction or the other depending on whether the displacement is towards the top or the bottom of the locking bolt.

In a variant to implementing this invention, the assembly arrangement can be provided with a mounting base where the upper section will be such that it allows it to accept the base of the lower module, which will be able to be locked on to it. To allow this, it would be advantageous if the upper section of the mounting base were identical with the upper section of the modules.

FIG. 10 shows a variant of the invention comprising an arrangement of n modules in which only the lower module 2*n* is shown. It is intended to be positioned and fixed into mounting base 70. In this way, the upper section of mounting base 70 will be a replica of the upper sections of the modules.

Such an arrangement is interesting in that it ensures controlled stabilization of the assembly arrangement with respect to the mounting surface, whether this mounting surface is a building or a vehicle. In this way, mounting base 70 is provided with the means to ensure it can be fixed to mounting surface 73. Providing a particularly simple solution, these means can comprise screws 72 or an adhesive system or any other suitable means of fixing. Once the mounting base is fixed to the mounting surface and lower module 2*n* is in place and locked to it, the fixing means then becoming inaccessible, the assembly arrangement cannot be moved, and is secure.

Of course, it is equally possible to ensure the fixing of an assembly arrangement as per the invention onto a cover which itself is fixed to the underside of a horizontal, internal surface such as a ceiling or the underside of a workbench. In this type of implementation, the lower face of the cover will have the form of the base of a module. In this way the upper section of the upper module can be attached to the cover and locked to it. This was the situation in the preceding example with base 70.

Moreover, the means for locking and solidly connecting an assembly arrangement together as per the invention could be of the electromechanical and/or electrical and/or electronic type.

The invention claimed is:

1. A modular assembly for the storage of items comprising a plurality of modules adapted to be stacked one atop another, one of said plurality of modules being a first module, and a vertically adjacent module being a second module;

each module comprising a substantially rectangular base, a left rectangular lateral side having an upper edge and a lower edge, a right rectangular lateral side having an upper edge and a lower edge, a front face, an upper section, a lower section, and a rear wall;

each module having a means for access and closure selected from the group consisting of a front curtain, front door, one or more drawers, and top cover; and each module having a knob connected to a plate that is roller mounted in a transverse direction to the means for access and parallel with the base, said plate including a slot inclined at an angle to the front face of the module, said plate being displaceable by said knob, said slot being joined to a lug that is connected to a lever which is mounted on a roller guide mechanism, said lever being connected to a plurality of links, connecting on a left and right side of said lever, said links connecting to roller mounted shafts, said roller mounted shafts extending to holes on the left and right sides of the module, near the base, said module further including holes in the upper section on the left and right sides of the module.

2. The modular assembly of claim 1, further comprising at least one vertical sliding locking bolt mounted in each of the left and right lateral sides of the module, each of said vertical sliding locking bolts having a length and comprising a flat shaft with rectangular slotted holes evenly separated along said length; and wherein at least one of the roller mounted shafts on each of the left and right sides of the lever is terminated with a vertical section which is perpendicular to said roller mounted shaft and which forms a slide runner mounted to a sliding block provided with two perpendicular lugs.

3. The modular assembly of claim 1, further comprising a means for ensuring the correct positioning of the first module with respect to the second module, comprising two complementarily formed rebates on the upper and lower edges of the lateral sides, whereby the lower edges of the lateral sides of the first module engage with the upper edges of the lateral sides of the second module.

4. The modular assembly of claim 1, further comprising a mounting base in the shape of the upper section of one of the plurality of modules of the modular assembly, said mounting base being adapted to accept the lower section of such a module of the modular assembly, whereby the module located at the bottom of the modular assembly is capable of being locked onto the mounting base.

5. The modular assembly of claim 1, further comprising a cover in the shape of the lower section of one of the plurality of modules of the modular assembly adapted to accept the upper section of such a module located at the top of the modular assembly, whereby the module located at the top of the modular assembly is capable of being locked onto the cover.

* * * * *